United States Patent [19]

Silbernagel et al.

[11] Patent Number: 5,067,849

[45] Date of Patent: Nov. 26, 1991

[54] MARKING NAIL HAVING BODY SUITABLE FOR MAGAZINE FEEDING AND MECHANICAL INSTALLATION

[75] Inventors: Hermann Silbernagel, Friesenheimerstrasse 7a, D-6800 Mannheim 1; Ulfried Wiegand, Bleckede, both of Fed. Rep. of Germany

[73] Assignees: Hermann Silbernagel, Mannheim; Beiersdorf AG, Hamburg, both of Fed. Rep. of Germany

[21] Appl. No.: 446,102

[22] Filed: Dec. 8, 1989

[30] Foreign Application Priority Data

Dec. 6, 1988 [DE] Fed. Rep. of Germany ... 8815134[U]

[51] Int. Cl.[5] ..... E01F 9/06; E01F 9/10

[52] U.S. Cl. ..... 404/9; 404/16; 116/63 R

[58] Field of Search ..... 404/6, 9, 12–15, 404/16; 116/63 R; 350/97, 104

[56] References Cited

U.S. PATENT DOCUMENTS

| | | | |
|---|---|---|---|
| 2,303,462 | 12/1942 | Horne | 404/9 |
| 2,664,065 | 12/1953 | Thompson | 404/12 X |
| 2,739,222 | 3/1956 | Gard | 404/9 |
| 3,040,636 | 6/1962 | Gregoire et al. | 404/15 |
| 3,096,694 | 7/1963 | Lynn | 404/12 |
| 3,179,009 | 4/1965 | Sheffield et al. | 404/12 X |
| 3,427,933 | 2/1969 | Taylor-Myers | 404/9 |
| 3,499,371 | 3/1970 | Jonnes et al. | 404/9 |
| 3,971,623 | 7/1976 | Hedgewick et al. | 404/12 X |
| 4,088,416 | 5/1978 | Taylor | 404/15 |
| 4,717,281 | 1/1988 | Shepard et al. | 404/9 |

FOREIGN PATENT DOCUMENTS

| | | | |
|---|---|---|---|
| 2122240 | 1/1984 | United Kingdom | 404/9 |

*Primary Examiner*—Stephen J. Novosad
*Attorney, Agent, or Firm*—Staas & Halsey

[57] ABSTRACT

A road-marking nail includes a body having a substantially hemispherical shape and a vertical axis. The body is formed to have holes, notches, or projections to facilitate magazine feeding, and grooves, holes, or undercuts to facilitate mechanical grasping. Cat's-eye reflectors can be disposed in recesses formed in the body.

15 Claims, 3 Drawing Sheets

MARKING NAIL HAVING BODY SUITABLE FOR MAGAZINE FEEDING AND MECHANICAL INSTALLATION

BACKGROUND OF THE INVENTION

1. Field of the Invention:

Road-marking nails are used wherever making stripes for guiding traffic have not proven useful, especially in cases of temporary traffic arrangements, e.g. at construction sites. The usual distances between the individual nails are 0.33 m and 0.50 m.

Conventionally, such nails are applied to the road pavement manually over long segments of road. This is very costly in terms of time and expense. Thus, marking nails whose shape makes it possible to install them mechanically are not known.

SUMMARY OF THE INVENTION

An object of the invention is therefore to provide a road-marking nail, which is preferably of hermispherical shape, and is provided with cat's-eye reflectors arranged in recesses, in order to enhance traffic safety, and further has holes and/or notches and/or projections for the purpose of magazine feeding, and for the purpose of mechanical grasping has grasping grooves and/or holes and/or undercuts, so as to permit automatic installation of the road-marking nails.

This object is achieved by providing a road marking nail of preferably hemispherical shape, with cat's-eye reflectors in recesses, means for feeding the nail and for mechanically grasping the nail. The feeding means can be a hole and/or a notch and/or a projection, while the grasping means can be grooves, holes, and/or undercuts.

DETAILED DESCRIPTION OF THE PREFERRED EMBODIMENTS

Figure 1:
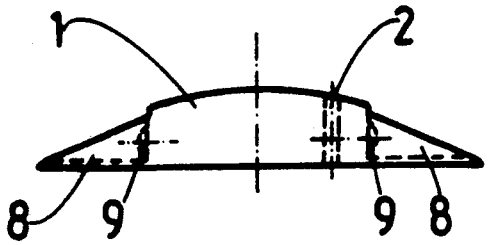
FIG. 1 is a side elevational view of a road-marking nail with a hole running vertically through the nail for the purpose of magazine feeding.

FIG. 1 shows a road-marking nail in accordance with the present invention. In this embodiment, the nail has a hole 2, which runs vertically through the nail 1. Here the arrangement of the hole 2 depends on the magazine tool. Thus, this hole 2 can also be arranged through the center of the nail 1, as shown in FIG. 2, or at both sides of the center, as shown in FIG. 3.

Figure 2:
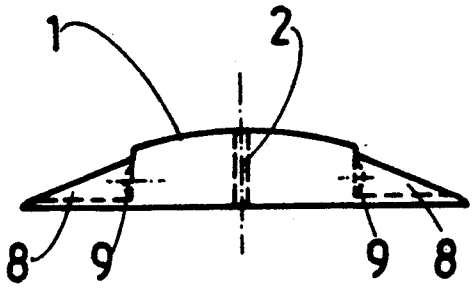
FIG. 2 shows a variant of FIG. 1, where the hole is arranged in the center of the nail.
Figure 3:
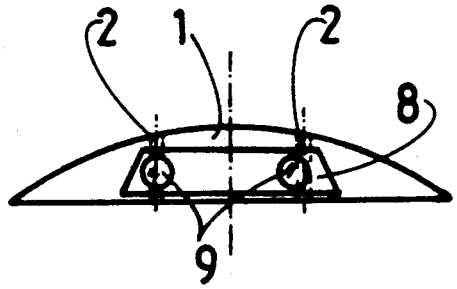
FIG. 3 shows a variant of FIGS. 1 and 2, where the hole is arranged at both sides of the center.
Figure 4:
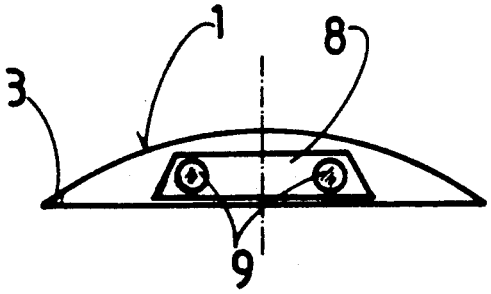
FIG. 4 shows the road-marking nail with a notch at the edge of the nail for the purposes of magazine feeding, as a variant of FIGS. 1 to 3.
Figure 5:
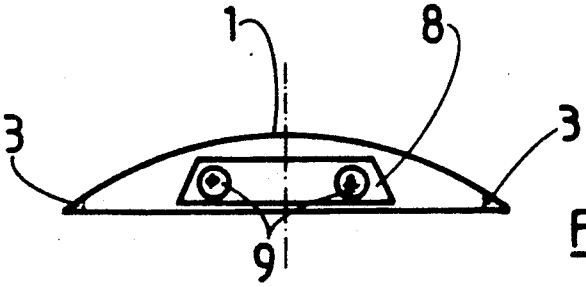
FIG. 5 shows a variant of FIG. 4 with notches at both sides.

FIG. 4 shows a variant of FIGS. 1 to 3, where, instead of a hole at one side of nail 1, a notch 3 is arranged, e.g. at the edge of the nail. This notch 3 can also be arranged at diametrically opposite sides as represented in FIG. 5, or circularly.

Figure 6:
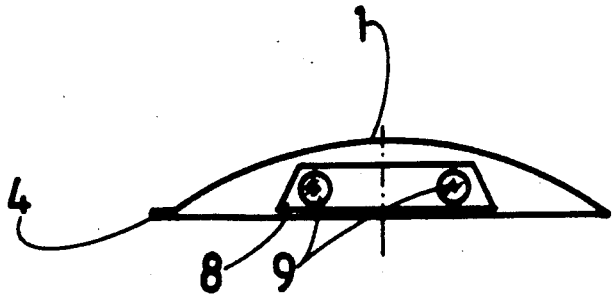
FIG. 6 shows a road-marking nail with a projection at one side for purposes of magazine feeding.
Figure 7:
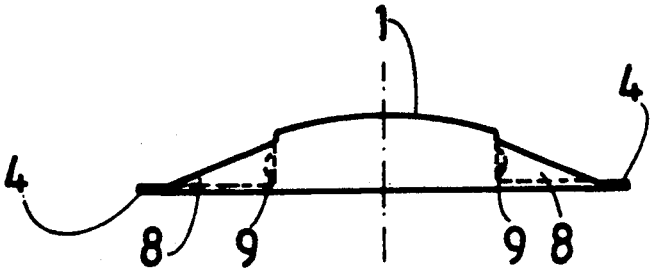
FIG. 7 shows a variant of FIG. 6 with a projection at both sides.

FIG. 6 shows a further variant with a projection 4, and FIG. 7 a variant with projections at diametrically opposite sides or circularly arranged projections 4.

The embodiments in accordance with FIGS. 1 to 7 represent features which make it possible to hold the road-marking nail 1 in accordance with the invention in magazines. Obviously other take-up noses, notching arrangements, etc., are also within the scope of this invention.

FIGS. 8 to 12 show embodiments of the road-marking nail 1 in accordance with the invention with such structural features as can be utilized for the mechanical installation of the road-marking nail 1.

Figure 8:
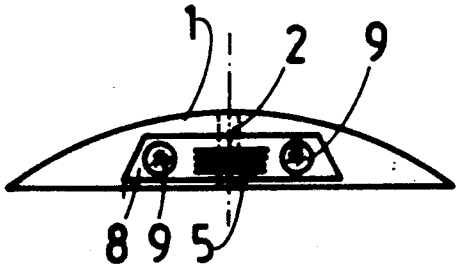
FIG. 8 shows a road-marking nail with an arrangement of grasping grooves for the purposes of mechanical engagement.

For example, as shown in FIG. 8, these may be grasping grooves 5, which are arranged in the region of depressions 8, preferably between the cat's-eye reflectors 9. In this embodiment, the grasping grooves 5 are arranged horizontally; however, these can also run vertically, if a corresponding grasping tool is available for this purpose.

Figure 9:
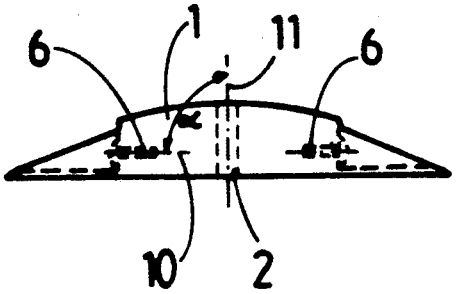
FIG. 9 shows a variant of FIG. 8 with holes in the region of the recesses.

FIG. 9 shows a variant in which holes 6 are arranged, whose axis of engagement 10 forms an angle $\alpha$ relative to the axis of the nail 11.

Figure 10:
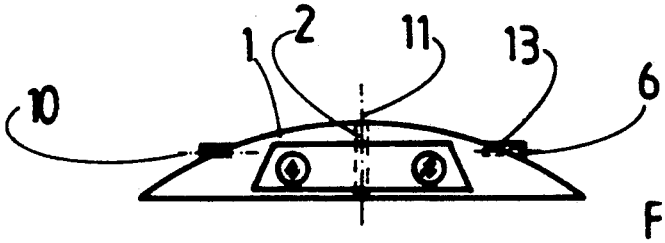
FIG. 10 shows a variant of FIGS. 8 and 9 with holes arranged in projections.

Optionally these holes 6 are arranged in projections 13, as represented in FIG. 10.

Figure 11:
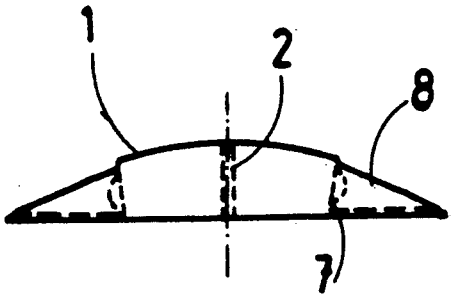
FIG. 11 shows a variant of FIGS. 8 to 10 with an arrangement of undercuts.

In FIG. 11, an undercut 7 is arranged in the region of the recess 8, so that this design permits the engagement of the grasping tool.

In general, the embodiments in accordance with FIGS. 8 to 11 serve for grasping tools whose axis of engagement 10 forms an angle $\alpha$ relative to the axis of the nail 11.

If the engaging tool operates like tongs, the angle $\alpha$ will be smaller than 90°.

Figure 12:
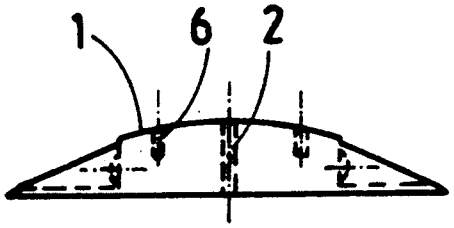
FIG. 12 shows a further variant in which the axis of engagement for the mechanical grasping tool runs axially to the axis of the nail.

However, it is also conceivable to arrange the axis of engagement to be axial to the axis of the nail, i.e., running along with it, as shown in FIG. 12. Such an axis of engagement should be provided if the engagement tool is inserted in the nail vertically. The engagement tool is then correctly pressed into hole 6, and during installation it (i.e. the nail) is placed on the road, and separated from the tool, by a pressure tamper or the like.

Figure 13:
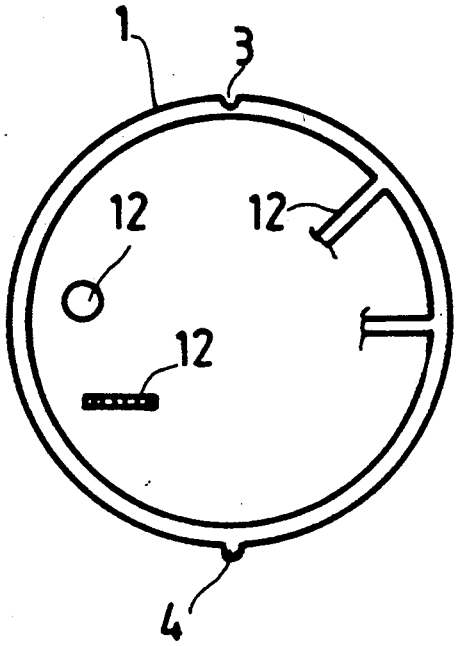
FIG. 13 is a button view of the nail.

FIG. 13 shows the bottom side of the nail. The bottom side should, as far as possible, be constructed with a multiplicity of retention sites 12, which assure a satisfactory adhesion to the substrate.

With the present invention, a road-marking nail is provided which, because of its magazine-feeding capability, permits mechanical installation and thus can be handled efficiently.

What is claimed is:

1. A road-marker comprising:

a body having a substantially hemispherical shape and a vertical axis;

means, formed in the body, for magazine feeding the body;

means, formed in the body, for mechanically grasping the body; and cat's-eye reflectors disposed on the body.

2. A road-marker according to claim 1, wherein the magazine feeding means is a hole extending through the body and having an axis parallel to the axis of the body.

3. A road-marker according to claim 2, wherein the hole is coaxial with the axis of the body.

4. A road-marker according to claim 1, wherein the magazine feeding means comprises first and second holes having vertical axes and extending through the body and being disposed on opposite sides of the axis of the body.

5. A road-marker according to claim 1, wherein the magazine feeding means is a notch formed in a peripheral edge of the body.

6. A road-marker according to claim 1, wherein the magazine feeding means comprises a pair of notches formed on diametrically opposite sides in a peripheral edge of the body.

7. A road-marker according to claim 1, wherein the magazine feeding means is a projection formed in a peripheral edge of the body.

8. A road-marker according to claim 1, wherein the magazine feeding means comprises a pair of projections formed on diametrically opposite sides on a peripheral edge of the body.

9. A road-marker according to claim 1, wherein the grasping means comprises a plurality of horizontally oriented grasping grooves formed in the body.

10. A road-marker according to claim 1, wherein the cat's eye reflectors are disposed in recesses formed in the body.

11. A road-marker according to claim 10, wherein the grasping means comprises a plurality of grasping grooves formed in recesses of the body, wherein the cat's-eye reflectors are disposed in the recesses on opposite sides of the grooves.

12. A road-marker according to claim 1, wherein the grasping means comprises a pair of holes extending horizontally into the body from depressions formed in the body.

13. A road-marker according to claim 1, wherein the grasping means is an undercut formed in depressions formed in the body.

14. A road-marker according to claim 12, wherein the pair of holes define an axis of engagement for a mechanical grasping tool, the axis of engagement being at an angle relative to the vertical axis of the body.

15. A road-marker according to claim 1, wherein a bottom edge of the body includes retention sites.

* * * * *